US010842703B2

(12) United States Patent
Zhang

(10) Patent No.: US 10,842,703 B2
(45) Date of Patent: Nov. 24, 2020

(54) RECIPROCATING-HIT TREATMENT INSTRUMENT

(71) Applicant: SUZHOU KAIYUN SPORTS TECH LTD., Jiangsu (CN)

(72) Inventor: Changjuan Zhang, Jiangsu (CN)

(73) Assignee: SUZHOU KAIYUN SPORTS TECH LTD. (CN)

( * ) Notice: Subject to any disclaimer, the term of this patent is extended or adjusted under 35 U.S.C. 154(b) by 316 days.

(21) Appl. No.: 15/841,019

(22) Filed: Dec. 13, 2017

(65) Prior Publication Data

US 2019/0175434 A1 Jun. 13, 2019

(51) Int. Cl.

| | |
|---|---|
| ***A61H 23/00*** | (2006.01) |
| ***A61H 23/06*** | (2006.01) |
| ***A61H 15/00*** | (2006.01) |
| ***A61H 1/00*** | (2006.01) |

(52) U.S. Cl.

CPC ..... *A61H 1/008* (2013.01); *A61H 15/0085* (2013.01); *A61H 23/006* (2013.01); *A61H 23/06* (2013.01); *A61H 2015/0042* (2013.01); *A61H 2201/1669* (2013.01)

(58) Field of Classification Search

CPC ..... A61H 1/008; A61H 23/006; A61H 23/06; A61H 23/00; A61H 15/0078; A61H 15/0085; A61H 2201/1685; A61H 2201/0107

USPC ..... 411/326, 949, 216, 939

See application file for complete search history.

(56) References Cited

U.S. PATENT DOCUMENTS

| | | | | |
|---|---|---|---|---|
| 733,754 A * | 7/1903 | Secor | F16B 39/06 | 411/322 |
| 4,513,737 A * | 4/1985 | Mabuchi | A61H 23/0254 | 601/101 |
| D373,197 S * | 8/1996 | Schepper | D24/214 | |
| 6,228,042 B1 * | 5/2001 | Dungan | A61H 1/008 | 601/101 |

(Continued)

FOREIGN PATENT DOCUMENTS

| | | |
|---|---|---|
| CN | 106137709 A * | 11/2016 |
| CN | 206304128 U | 7/2017 |

(Continued)

*Primary Examiner* — Justine R Yu
*Assistant Examiner* — Kelsey E Baller
(74) *Attorney, Agent, or Firm* — Fresh IP PLC; Aubrey Y Chen

(57) ABSTRACT

Disclosed is a reciprocating-hit treatment instrument including a body having a reciprocating mechanism, wherein the body includes a main handle portion at the lower portion, a sub-handle portion at the upper portion, a base portion extruding from one side of the connection portion between the main handle portion and the sub-handle portion on the body, a reciprocating rod with the front end extending out from the base portion while the rear end fixedly connected with the reciprocating mechanism and able to perform a reciprocating motion in the direction of its own length under the driven by the reciprocating mechanism, and a treatment ball connected with the front end of the reciprocating rod; the main handle portion, the sub-handle portion, and the base portion are integrally connected, and the main handle portion and the sub-handle portion are connected with each other in the shape of a bar.

14 Claims, 17 Drawing Sheets

(56) References Cited

U.S. PATENT DOCUMENTS

| | | | | |
|---|---|---|---|---|
| 6,805,700 | B2 * | 10/2004 | Miller | A61H 23/02 601/108 |
| 6,949,110 | B2 * | 9/2005 | Ark | A61B 17/142 173/217 |
| 7,207,957 | B2 * | 4/2007 | Szczepanski | A61H 15/0085 601/112 |
| 9,486,387 | B2 * | 11/2016 | Crowell | A61H 15/0092 |
| D837,395 | S * | 1/2019 | Gan | A61H 7/001 D24/214 |
| 10,314,762 | B1 * | 6/2019 | Marton | A61H 1/008 |
| D875,961 | S * | 2/2020 | Li | D24/211 |
| 2010/0137907 | A1 * | 6/2010 | Tsai | A61H 1/008 606/238 |
| 2016/0120243 | A1 * | 5/2016 | Matzel | A41D 19/0082 2/161.6 |
| 2016/0367425 | A1 * | 12/2016 | Wersland | A61H 1/00 |
| 2017/0042754 | A1 * | 2/2017 | Fowers | A61H 7/001 |
| 2017/0304145 | A1 * | 10/2017 | Pepe | A61H 23/0254 |
| 2019/0017528 | A1 * | 1/2019 | Wersland | A61H 1/008 |

FOREIGN PATENT DOCUMENTS

| | | | |
|---|---|---|---|
| CN | 107019627 | A | 8/2017 |
| CN | 107949362 | A | 4/2018 |

* cited by examiner

RECIPROCATING-HIT TREATMENT INSTRUMENT

BACKGROUND OF THE INVENTION

1. Technical Field

The present invention belongs to the field of equipment for treating muscular tissue of a human body, and specifically to a reciprocating-hit treatment instrument.

2. Description of Related Art

The existing hit massager adopts a method where the reciprocating rod is detachably connected with the body, and each of different hit heads is fixed with one reciprocating rod; different hit heads are selected to allow its reciprocating rods to be inserted into the body and then be fixed via a locking structure, with each hit head requiring a reciprocating rod, which has high costs. Meanwhile, since the reciprocating rod is detachably connected with the body, it is necessary to design a specific detachable locking structure. The detachable locking structure is easily broken and loosened during use due to the rapid reciprocating motion at a high frequency, and at the same time, in the process of the reciprocating-hit vibration, the detaching point of the reciprocating rod easily produces rebound vibration which affects the use effect, which is more likely to damage the various structural components. For example, a reciprocal treatment device disclosed in US2017027798 comprises a battery, a motor, a trigger, an actuation output and a treatment structure, wherein the treatment structure is as the above style and each with a reciprocating rod plugged in the body, which has high production costs; if damaged, the whole structure needs to be replaced, thus generating high maintenance costs. The main body of the treatment device is of a ringlike shape, with a large volume, a complicated structure and a large number of corners; in actual operation, the range of treatment is limited and the operation is inconvenient.

BRIEF SUMMARY OF THE INVENTION

The objective of the present invention is to provide a reciprocating treatment instrument which is particularly suitable for quicker relief of muscle pressure by athletes in order to solve the above problem.

To achieve the above-mentioned technical objective, the present invention adopts the following technical solution:

a reciprocating-hit treatment instrument, comprising a body having a reciprocating mechanism therein, wherein the body comprises a main handle portion at the lower portion, a sub-handle portion at the upper portion, a base portion extruding from one side of the connection portion between the main handle portion and the sub-handle portion on the body, a reciprocating rod with the front end extending out from the base portion while the rear end is in fixed connected with the reciprocating mechanism and is able to perform reciprocating motion in the direction of its own length under the driven by the reciprocating mechanism, and a treatment ball connected with the front end of the reciprocating rod; the main handle portion, the sub-handle portion and the base portion are integrally connected, and the main handle portion and the sub-handle portion are connected with each other in the shape of a bar, the main handle portion having a greater length than the sub-handle portion.

The main body of the present application is similar to a bar-shaped straight handle, which is suitable for micro-bending of ergonomics; the middle-upper part of the basement extends out to connect the treatment ball. Such a design facilitates that all fingers can hold the main handle portion, while the main body of a hand can grip the main handle portion if needed and partially grip the sub-handle portion to ensure a stable force and less effort. The entire treatment instrument is of a simple and concise structure with a small size for easy operation and a wide range of applications. The reciprocating mechanism is provided in the base portion, with the motor provided in the sub-handle portion, having a reasonable and concise arrangement.

Preferably, the main handle portion is provided with a fluctuating finger gripping portion on the same side as the base portion, and the bottom of the main handle portion is integrally connected with a base capable of supporting the body stably.

The base is flat, with its cross section larger than the cross section of the body.

Preferably, the reciprocating rod is a snap-in quick-clip connection rod inserted into the base portion.

The reciprocating rod can adopt the existing snap-in quick-clip structure.

Preferably, the treatment ball comprises a core of the treatment ball connected with the reciprocating rod and a treatment sleeve detachably sleeved on the core of the treatment ball and having elasticity.

Preferably, the treatment sleeve can be a plurality of replaceable treatment sleeves with different thicknesses; a plurality of bumps integrally connected with the treatment sleeve are uniformly or scatteredly distributed over the upper portion or the entire area of the outer surface of the treatment sleeve.

At least the top of the bump is a smooth spherical surface, which increases the hitting comfort. Generally, the bumps are smaller with a more intensive design, mainly distributed in a treatment area in contact with the human body; a plurality of small bumps increase the hitting points, thus improving the comfort of massage and treatment.

Preferably, the reciprocating rod is non-detachably traversed on the body, and the core of the treatment ball is detachably connected with the reciprocating rod, with the core of the treatment ball provided with an internally threaded hole and the front end of the reciprocating rod screwed into the internally threaded hole;

the reciprocating rod and the body are non-detachably connected, and only a suitable treatment sleeve needs to be replaced for the treatment of different individuals in different positions, thus avoiding the replacement of the reciprocating rod and the core of the treatment ball and saving costs.

In case the reciprocating rod is detachably connected with the body, it is necessary to design a special detachable locking structure. Therefore, the detachable locking structure is easily broken and loosened due to the rapid reciprocating motion at a high frequency in the using process; at the same time, the detaching point of the reciprocating rod easily produces a rebound vibration in the vibrating process of the reciprocating hit, which impacts the use effects and tends to damage the various structural components. The present application adopts the method of replacing the elastic treatment sleeve, which not only saves costs but also improves the stability of the structure of each component in the process of reciprocating hits at a high frequency and prolongs the service life of the reciprocating rod and the core of the treatment ball; the treatment sleeve is tightly sleeved on the core of the treatment ball with elasticity, which avoids rebound vibration, providing a better treatment effect and comfort during use, and reducing the costs of replacing the treatment sleeve when damaged.

The core of the treatment ball and the reciprocating rod can either be non-detachably fixedly connected or screwed as mentioned above; by changing the different thickness of the treatment sleeve, that is, by changing the size of the treatment sleeve, the treatment needs of different individuals and different positions can be met.

Preferably, the treatment sleeve comprises an inner surface adapted to the outer contour of the core of the treatment ball by an interference fit, and a spherical outer surface or an outer shell with an outer contour adapted to the positions of a human body.

The shape of the treatment sleeve mentioned above can be designed in various shapes to meet the treatment needs of different positions so as to achieve an efficient treatment effect.

Preferably, the outer shell of the sleeve comprises a plurality of hill-shaped projections continuous with a smooth transition, or two convex peaks arranged opposite to each other and a massage groove used for adapting the positions of a human body and formed in the middle portion by the opposite-arranged convex peaks; or the outer shell of the sleeve is of an elongated oval shape or a UFO shape.

The shape of the treatment sleeve can be any of the various shapes mentioned above and is not limited to the above-mentioned shapes.

Preferably, the treatment sleeve comprises a face portion used for the treatment and sleeved in the middle-front portion of the core of the treatment ball, and a wire mesh portion used for fixing the treatment sleeve on the core of the treatment ball and provided in the rear portion of the core of the treatment ball; the face portion covers at least ¾ of the core of the treatment ball from the front end to the rear end, and the opening at the rear end of the wire mesh portion forms a socket which is matched with the core of the treatment ball.

In order to ensure the comfort of treatment by way of hitting massage, the treatment sleeve may be made of materials with different hardnesses; since the rear end of the treatment sleeve needs to be tightened to encase the core of the treatment ball, the treatment sleeve requires good ductility to ensure the sleeving convenience of the treatment sleeve and the core of the treatment ball, so that many harder materials are not suitable for the design of the present application; in order to solve the above problems, the present application adopts the combination of a face and a wire for the treatment sleeve to allow most of the types of elastic treatment sleeves with any hardness easily sleeved on the core of the treatment ball while being closely matched with the core of the ball.

Preferably, the wire mesh portion comprises at least two ring wires symmetrically arranged on the face portion with both end portions of each ring wire integrally fixed with the face portion to form a ringlike shape, and the ring wire passes around the reciprocating rod for the pulling fixation of the face portion.

The wire mesh portion may be of a simple ring-wire structure, wherein both ends of the ring wire may be designed to be directly connected to the same position of the face portion or be close to the connecting position of the face portion so as to achieve a better restraining effect.

Preferably, the end of the wire mesh portion close to the rear end of the core of the treatment ball is provided with an elastic closing-wire in the form of a closed ring, and the wall surface of the front portion of the reciprocating rod is provided with a fixed structure matched with the closing-wire for fixing the closing-wire.

Preferably, the fixed structure comprises a stop tongue portion for fixing the winding start-point of the closing-wire when the wire is wound and a hooked tongue portion for fixing the wound closing-wire after the winding is completed, wherein the stop tongue portion is disposed near the front end of the reciprocating rod relative to the hooked tongue portion, the extending directions of the stop tongue portion and hooked tongue portion are parallel to the radial cross section of the reciprocating rod and opposite to each other, and the stop tongue portion and the hooked tongue portion extend in the direction of a peripheral arc of the reciprocating rod and form a wire-winding area in between.

The design of the closing-wire structure mentioned above allows the face-and-line combined treatment sleeve to be more tightly sleeved on the core of the treatment ball. Meanwhile, the setting of the stop tongue portion and the hooked tongue portion facilitates the fast fixation of the closing-wire and convenient operation, thus improving the convenience of replacing the treatment sleeve.

Preferably, the front portion of the reciprocating rod is provided with a locking-rod mechanism which comprises a locking rod capable of reciprocating motion along the direction of the length of the reciprocating rod and a top-pressure spring embedded in the reciprocating rod, wherein a part of the locking rod is embedded in the reciprocating rod to form a guiding rod portion and a part of the locking rod exceeds the peripheral wall surface of the reciprocating rod to form a locking rod portion, and the locking rod portion is connected to the middle portion of the guiding rod portion, with the wall of the internally threaded hole of the core of the treatment ball provided with a locking groove into which the locking rod can be inserted.

The locking rod mechanism ensures that the reciprocating rod and the core of the treatment ball will not be loosened when screwed together. When the reciprocating rod and the treatment core are screwed together, the locking rod is pulled backward to make the locking rod part and the threaded section at the front end of the reciprocating rod do not overlap, the locking rod can be loosened after the reciprocating rod and the core of the treatment ball are screwed and aligned, so that the locking rod allows the locking rod portion to be inserted into the locking groove under the effect of the top-pressure spring.

To sum up, the present invention can bring the following beneficial effects:

1. The main body of the present application is similar to a bar-shaped straight handle, which is suitable for micro-bending of ergonomics; the middle-upper part of the basement extends out to connect the treatment ball; the base extrudes from the middle-upper portion of the body to connect the treatment ball. Such a design facilitates all fingers being able to hold the main handle portion, while the main body of a hand can grip the main handle portion if needed and partially grip the sub-handle portion to ensure a stable force and less effort. The entire treatment instrument is of a simple and concise structure with a small size for easy operation and a wide range of applications. The reciprocating mechanism is provided in the base portion, with the motor provided in the sub-handle portion, having a reasonable and concise arrangement;

2. The reciprocating rod and the body are non-detachably connected, and only a suitable treatment sleeve needs to be replaced for the treatment of different individuals in different positions, thus avoiding the replacement of the reciprocating rod and the core of the treatment ball and saving costs;

3. The present application adopts the method of replacing the elastic treatment sleeve, which not only saves costs but also improves the stability of the structure of each component in the process of reciprocating hits at a high frequency and prolongs the service life of the reciprocating rod and the core of the treatment ball; the treatment sleeve is tightly sleeved on the core of the treatment ball with elasticity, which avoids the rebound vibration providing a better treatment effect and comfort during use and reducing the costs of replacing the treatment sleeve when damaged.

DETAILED DESCRIPTION OF THE INVENTION

Figure 1:
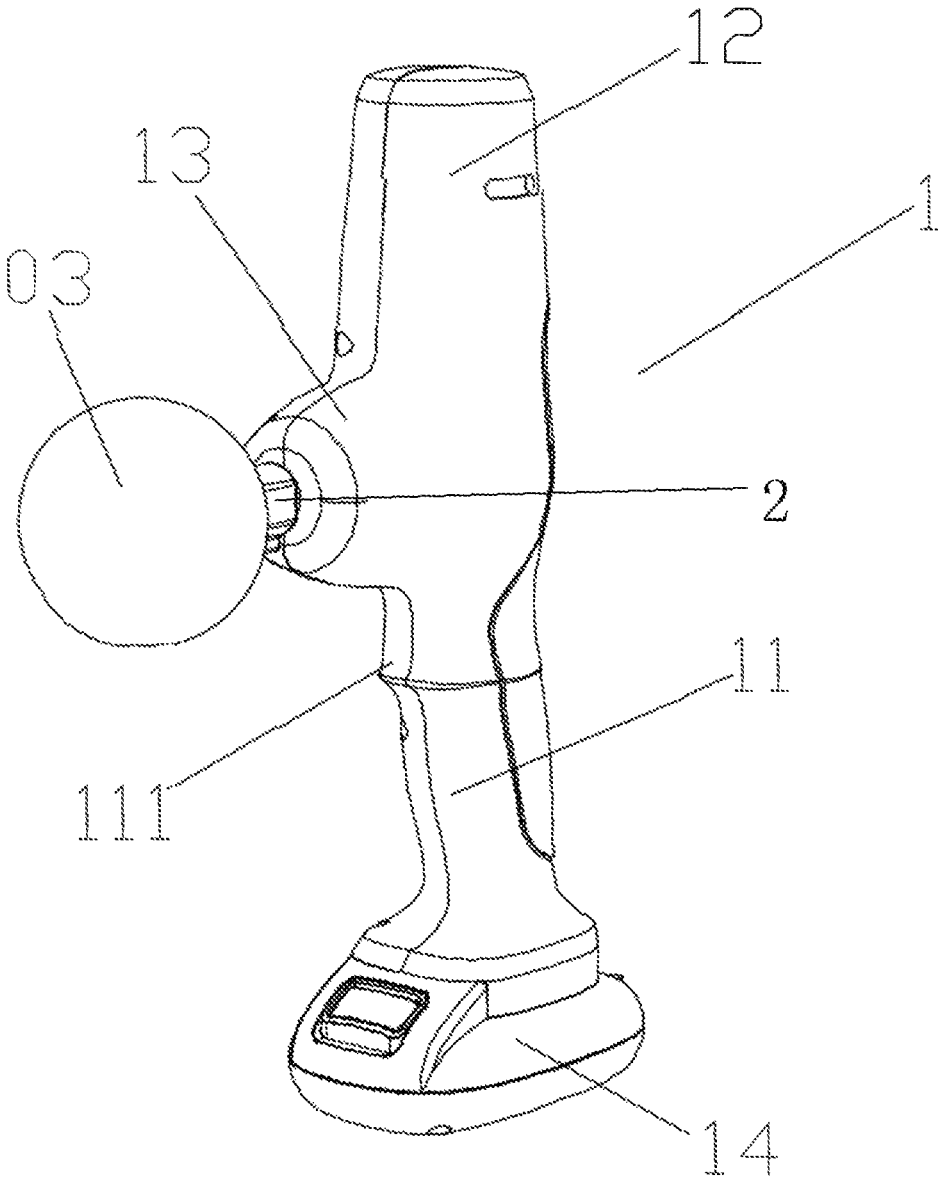
FIG. 1 is a structural diagram of the present application.
Figure 2:
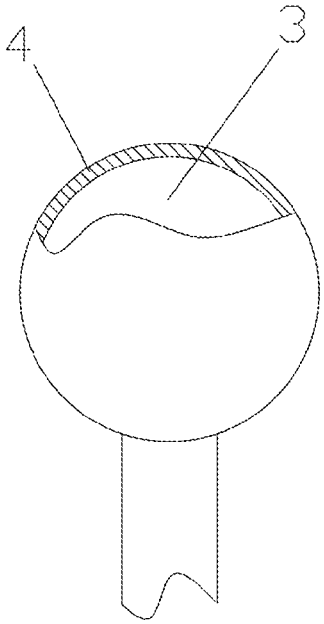
FIG. 2 is a structural diagram of the core of the treatment ball matched with the treatment sleeve.
Figure 3:
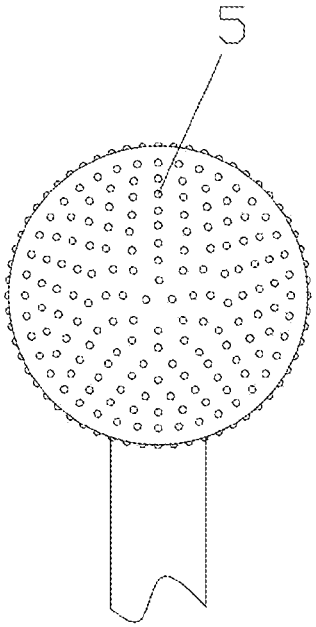
FIG. 3 is a structural diagram of the treatment sleeve with bumps.
Figure 4:
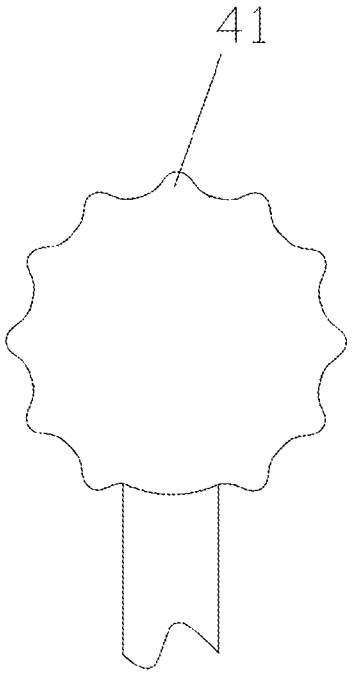
FIG. 4 is a structural diagram of the treatment sleeve with hill-shaped projections.
Figure 5:
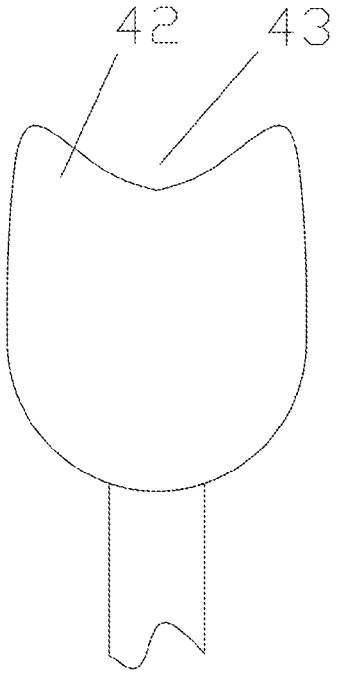
FIG. 5 is a structural diagram of the treatment sleeve with convex peaks.
Figure 6:
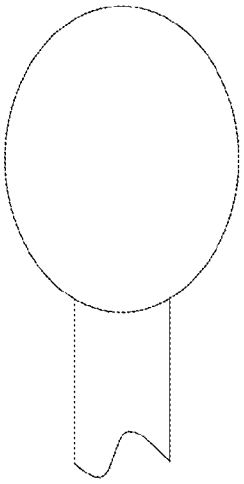
FIG. 6 is a structural diagram of the treatment sleeve of an oval shape.
Figure 7:
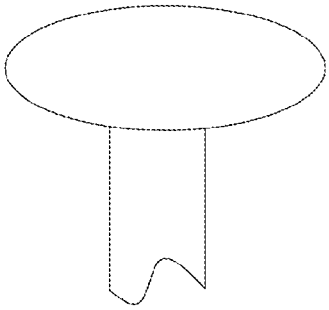
FIG. 7 is a structural diagram of the treatment sleeve of a UFO shape.
Figure 8:
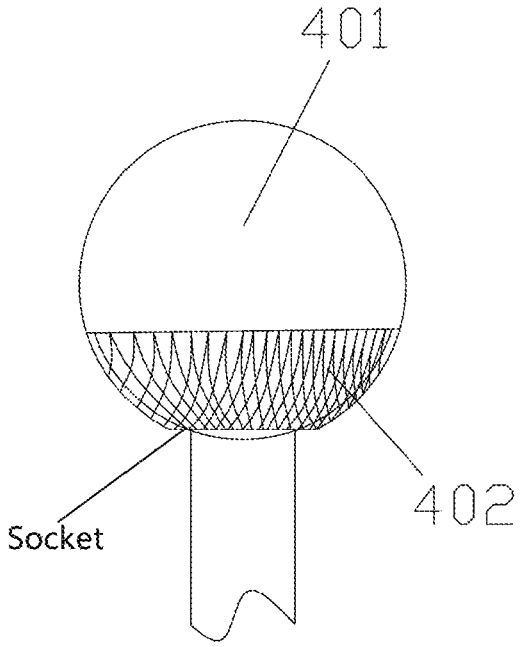
FIG. 8 is a structural diagram of the treatment sleeve with a face portion and a wire mesh portion.
Figure 9:
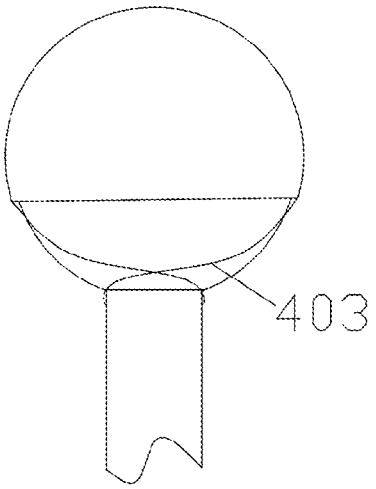
FIG. 9 is a structural diagram of the present application with a ring wire.
Figure 10:
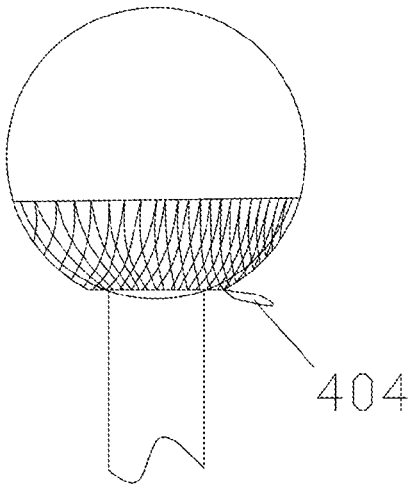
FIG. 10 is a structural diagram of the present invention with a closing-wire.
Figure 11:
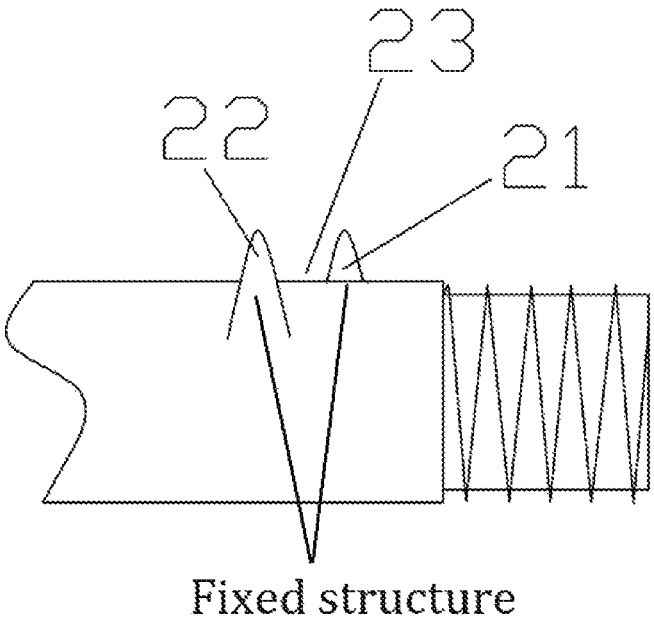
FIG. 11 is the first structural diagram of the fixed structure.
Figure 12:
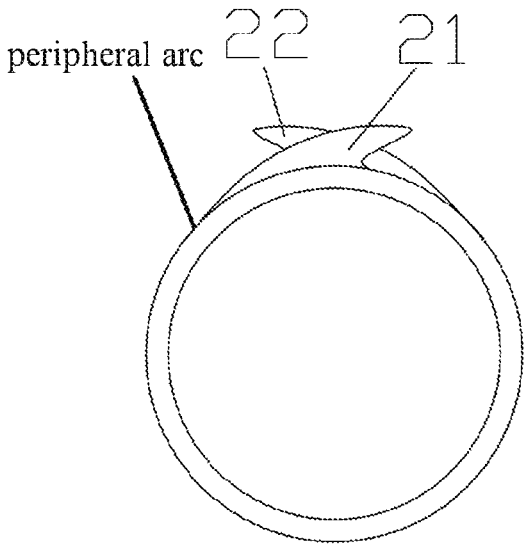
FIG. 12 is the second structural diagram of the fixed structure.
Figure 13:
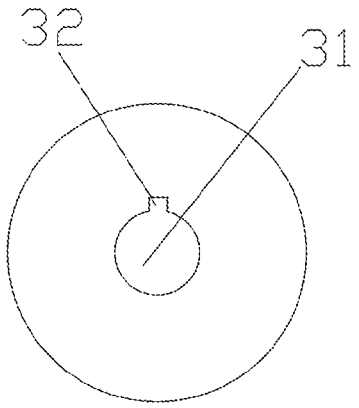
FIG. 13 is a structural diagram of the core of the treatment ball.
Figure 14:
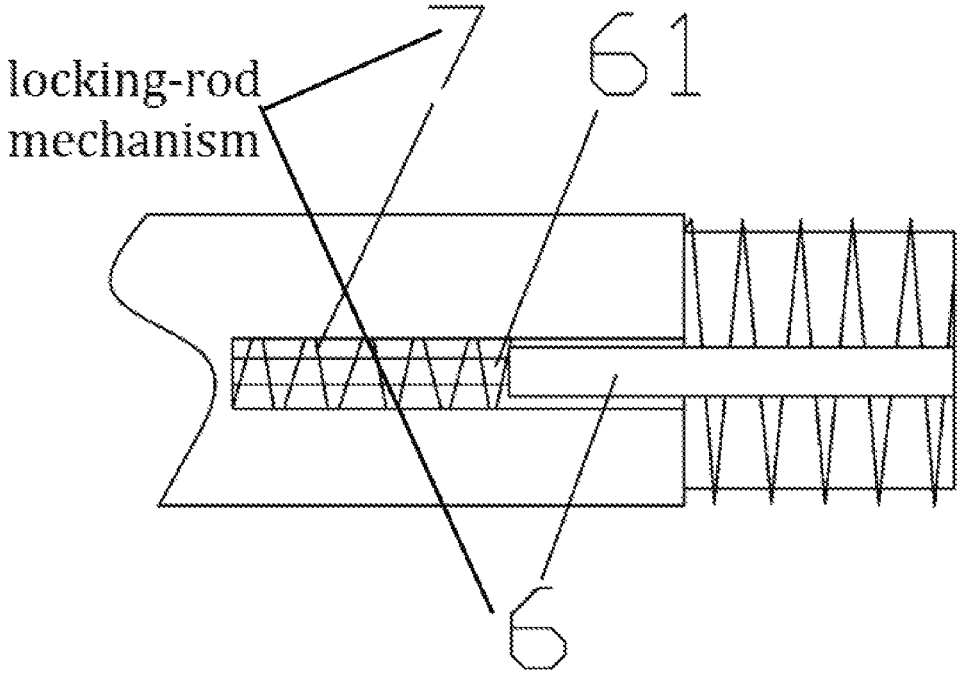
FIG. 14 is the first structural diagram of the locking-rod mechanism.
Figure 15:
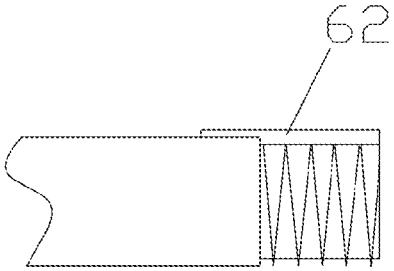
FIG. 15 is the second structural diagram of the locking-rod mechanism.
Figure 16:
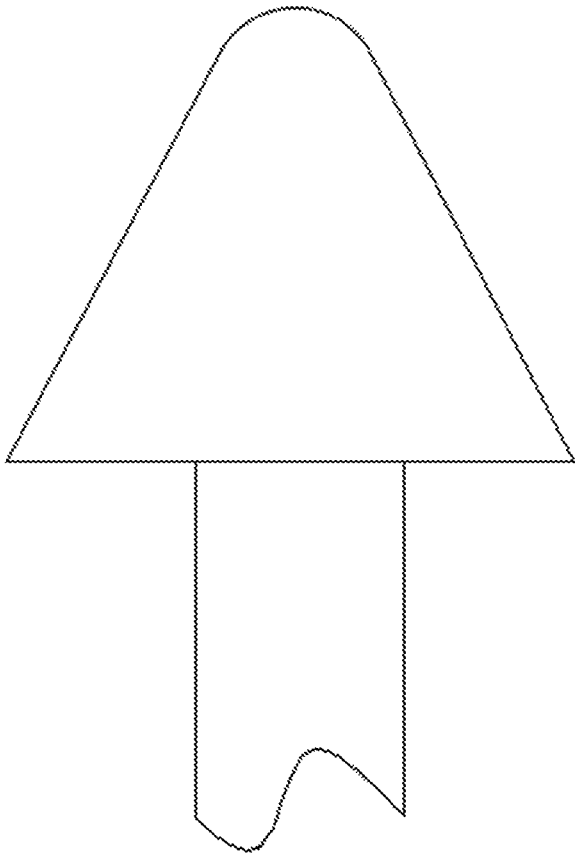
FIG. 16 is a structural diagram of the tapered treatment sleeve.
Figure 17:
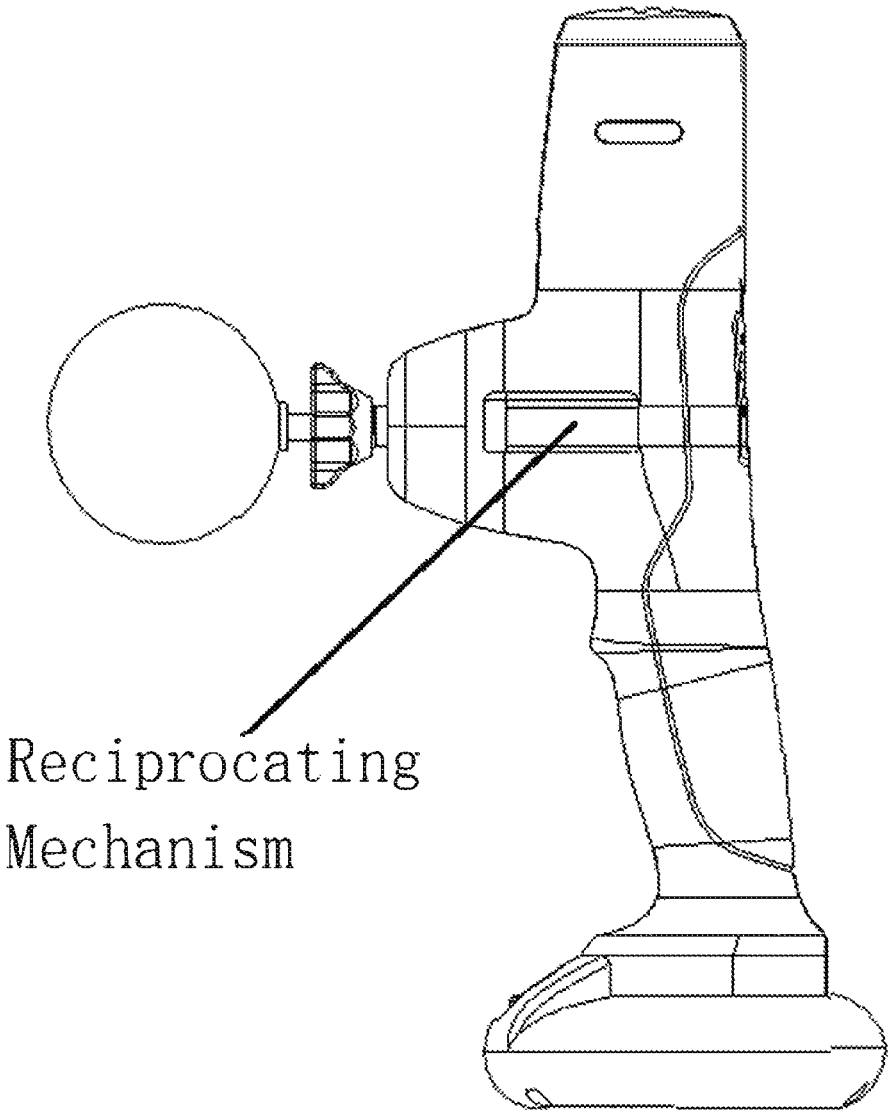
FIG. 17 is a structural diagram of the present application showing the reciprocating mechanism.

The present invention is further detailed in combination with the drawings as follows.

The embodiments are only provided to give instruction to the present invention, but not intended to limit the present invention. Those skilled in this art can make uncreative modifications to the embodiments according to their demands after having read the Specification. However, all such modifications are protected by the Patent Law provided they are within the scope of the Claims of the present invention.

Embodiment 1

A reciprocating-hit treatment instrument is provided, comprising a body 1 having a reciprocating mechanism therein, wherein the body 1 comprises a main handle portion 11 at the lower portion, a sub-handle portion 12 at the upper portion, a base portion 13 extruding from one side of the connection portion between the main handle portion 11 and the sub-handle portion 12 on the body 1, a reciprocating rod 2 with the front end extending out from the base portion 13 while the rear end is fixedly connected with the reciprocating mechanism and able to perform reciprocating motion along the direction of its own length under the driven by the reciprocating mechanism, and a treatment ball 03 connected with the front end of the reciprocating rod 2; the main handle portion 11, the sub-handle portion 12 and the base portion 13 are integrally connected, and the main handle portion 11 and the sub-handle portion 12 are connected with each other in the shape of a bar, the main handle portion 11 having a greater length than the sub-handle portion 12. The main body of the present application is similar to a bar-shaped straight handle, which is suitable for micro-bending of ergonomics; the middle-upper part of the basement extends out to connect the treatment ball. Such a design facilitates that all fingers can hold the main handle portion, while the main body of a hand can grip the main handle portion if needed and partially grip the sub-handle portion to ensure a stable force and less efforts. The entire treatment instrument is of a simple and concise structure with a small size for easy operation and a wide range of applications. The reciprocating mechanism is provided in the base portion, with the motor provided in the sub-handle portion, having a reasonable and concise arrangement. The main handle portion 11 is provided with a fluctuating finger gripping portion 111 on the same side as the base portion 13, and the bottom of the main handle portion 11 is integrally connected with a base 14 capable of standing the body 1 stably. The base 14 is flat, with its cross section larger than the cross section of the body 1.

The treatment ball 03 comprises a core 3 of the treatment ball 03 connected with the reciprocating rod 2 and a treatment sleeve 4 detachably sleeved on the core 3 of the treatment ball 03 and having elasticity.

Embodiment 2

The difference from the above embodiment is that the reciprocating rod 2 is a snap-in quick-clip connection rod inserted into the base portion 13. The reciprocating rod 2 can adopt the existing snap-in quick-clip structure.

Embodiment 3

The difference from the above embodiment is that the treatment sleeve 4 can be a plurality of replaceable treatment sleeves with different thicknesses; a plurality of bumps 5 integrally connected with the treatment sleeve 4 are uniformly or scatteredly distributed over the upper portion or the entire area of the outer surface of the treatment sleeve 4.

At least the top of the bump is a smooth spherical surface, which increases the hitting comfort. Generally, the bumps are smaller with a more intensive design, mainly distributed in a treatment area in contact with the human body; a plurality of small bumps increase the hitting points, thus improving the comfort of massage and treatment.

Embodiment 4

The difference from the above embodiment is that the reciprocating rod 2 is non-detachably traversed on the body 1, and the core 3 of the treatment ball 03 is detachably connected with the reciprocating rod 2, with the core 3 of the treatment ball 03 provided with an internally threaded hole 31 and the front end of the reciprocating rod 2 screwed into the internally threaded hole 31; the reciprocating rod 2 and the body 1 are non-detachably connected, and only a suitable treatment sleeve 4 needs to be replaced for the treatment of different individuals in different positions, thus avoiding the replacement of the reciprocating rod 2 and the core 3 of the treatment ball 03 and saving costs.

In case the reciprocating rod is detachably connected with the body, it is necessary to design a special detachable locking structure. Therefore, the detachable locking structure is easily broken and loosened due to the rapid reciprocating motion at a high frequency during the using process; at the same time, the detaching point of the reciprocating rod easily produces a rebound vibration in the vibrating process of reciprocating hit, which impacts the use effects and tends to damage the various structural components. The present application adopts the method of replacing the elastic treatment sleeve, which not only saves costs but also improves the stability of the structure of each component in the process of reciprocating hits at a high frequency and prolongs the service life of the reciprocating rod and the core of the treatment ball; the treatment sleeve is tightly sleeved on the core of the treatment ball with elasticity, which avoids the rebound vibration providing a better treatment effect and comfort during use, and reducing the costs of replacing the treatment sleeve when damaged.

The core 3 of the treatment ball 03 and the reciprocating rod 2 can either be non-detachably fixedly connected or screwed as mentioned above; by changing the different thickness of the treatment sleeve 4, that is, by changing the size of the treatment sleeve 4, the treatment needs of different individuals and different positions can be met.

Embodiment 5

The difference from the above embodiment is that the treatment sleeve 4 comprises an inner surface adapted to the outer contour of the core of the treatment ball by an interference fit, and a spherical outer surface or an outer shell with an outer contour adapted to the positions of a human body.

The shape of the treatment sleeve 4 mentioned above can be designed in various shapes to meet the treatment needs of different positions so as to achieve an efficient treatment effect.

Embodiment 6

The difference from the above embodiment is that the outer shell of the treatment sleeve 4 comprises a plurality of hill-shaped projections 41 continuous with a smooth transition.

Embodiment 7

The difference from the above embodiment is that the outer shell of the treatment sleeve 4 comprises two convex peaks 42 arranged opposite to each other and a massage groove 43 used for adapting the positions of a human body and formed in the middle portion by the opposite-arranged convex peaks 42.

Embodiment 8

The difference from the above embodiment is that the outer shell of the treatment sleeve 4 is of an elongated oval shape or a UFO shape.

Embodiment 9

The difference from the above embodiment is that the outer shell of the treatment sleeve 4 is of a tapered shape.

The shape of the treatment sleeve 4 can be of the various shapes mentioned above and is not limited to the above-mentioned shapes.

Embodiment 10

The difference from the above embodiment is that the treatment sleeve 4 comprises a face portion 401 used for the treatment and sleeved in the middle-front portion of the core 3 of the treatment ball 03, and a wire mesh portion 402 used for fixing the treatment sleeve 4 on the core of the treatment ball 03 and provided in the rear portion of the core 3 of the treatment ball 03; the face portion 401 covers at least ¾ of the core 3 of the treatment ball 03 from the front end to the rear end, and the opening at the rear end of the wire mesh portion 402 forms a socket which is matched with the core 3 of the treatment ball 03.

In order to ensure the comfort of treatment by way of hitting massage, the treatment sleeve may be made of materials with different hardnesses; since the rear end of the treatment sleeve needs to be tightened to encase the core of the treatment ball, the treatment sleeve requires good ductility to ensure the sleeving convenience of the treatment sleeve and the core of the treatment ball, so that many harder materials are not suitable for the design of the present application; in order to solve the above problems, the present application adopts the combination of a face and a wire for the treatment sleeve to allow most of the types of elastic treatment sleeves with any hardness easily sleeved on the core of the treatment ball while being closely matched with the core of the ball.

Embodiment 11

The difference from the above embodiment is that the wire mesh portion 402 comprises at least two ring wires 403 symmetrically arranged on the face portion 401 with both end portions of each ring wire integrally fixed with the face portion 401 to form a ringlike shape, and the ring wire 403 passes around the reciprocating rod for the pulling fixation of the face portion 401.

The wire mesh portion 402 may be of a simple ring-wire structure, wherein both ends of the ring wire 403 may be designed to be directly connected to the same position of the face portion 401 or be close to the connecting position of the face portion 401 so as to achieve a better restraining effect.

Embodiment 12

The difference from the above embodiment is that the end of the wire mesh portion 402 close to the rear end of the core 3 of the treatment ball 03 is provided with an elastic closing-wire 404 in the form of a closed ring, and the wall surface of the front portion of the reciprocating rod 2 is provided with a fixed structure matched with the closing-wire 404 for fixing the closing-wire 404.

Embodiment 13

The difference from the above embodiment is that the fixed structure comprises a stop tongue portion 21 for fixing the winding start-point of the closing-wire 404 when the wire 404 is wound and a hooked tongue portion 22 for fixing the wound closing-wire 404 after the winding is completed, wherein the stop tongue portion 21 of the closing-wire 404 is disposed near the front end of the reciprocating rod 2 relative to the hooked tongue portion 22, the extending directions of the stop tongue portion 21 and hooked tongue portion 22 are parallel to the radial cross section of the reciprocating rod 2 and opposite to each other, and the stop tongue portion 21 and the hooked tongue portion 22 extend in the direction of a peripheral arc of the reciprocating rod 2 and form a wire-winding area 23 in between.

The design of the closing-wire structure mentioned above allows the face-and-line combined treatment sleeve to be more tightly sleeved on the core of the treatment ball. Meanwhile, the setting of the stop tongue portion and the hookde hooked tongue portion facilitates the fast fixation of the closing-wire 404 and convenient operation, thus improving the convenience of replacing the treatment sleeve.

Embodiment 14

The difference from the above embodiment is that the front portion of the reciprocating rod 2 is provided with a locking-rod mechanism which comprises a locking rod 6 capable of reciprocating motion along the direction of the length of the reciprocating rod 2 and a top-pressure spring 7 embedded in the reciprocating rod 2, wherein a part of the locking rod 6 is embedded in the reciprocating rod 2 to form a guiding rod portion 61 and a part of the locking rod 6 exceeds the peripheral wall surface of the reciprocating rod 2 to form a locking rod portion 62, and the locking rod portion 62 is connected to the middle portion of the guiding rod portion 61, with the wall of the internally threaded hole of the core 3 of the treatment ball 03 provided with a locking groove 32 into which the locking rod 6 can be inserted.

The locking rod mechanism ensures that the reciprocating rod and the core of the treatment ball will not be loosened when screwed together. When the reciprocating rod and the treatment core are screwed together, the locking rod is pulled backward to make the locking rod part and the threaded section at the front end of the reciprocating rod do not overlap, the locking rod can be loosened after the reciprocating rod and the core of the treatment ball are screwed and aligned, so that the locking rod allows the locking rod portion to be inserted into the locking groove under the effect of the top-pressure spring.

What is claimed is:

1. A reciprocating-hit treatment instrument, comprising: a body having a reciprocating mechanism therein, wherein the body comprises a main handle portion at a lower portion, a sub-handle portion at an upper portion, a base portion extruding from one side of a connection portion between the main handle portion and the sub-handle portion on the body, a reciprocating rod with a front end extending out from the base portion while a rear end is fixedly connected with the reciprocating mechanism and configured to perform reciprocating motion in a direction of a length of the reciprocating rod under driving of the reciprocating mechanism, and a treatment ball connected with the front end of the reciprocating rod; the main handle portion, the sub-handle portion, and the base portion are integrally connected, and the main handle portion and the sub-handle portion are connected with each other to form a bar-shaped structure, the main handle portion having a greater length than the sub-handle portion;

wherein the treatment ball comprises a core of the treatment ball connected with the reciprocating rod and a treatment sleeve detachably sleeved on the core of the treatment ball and having elasticity; and wherein the treatment sleeve comprises a face portion sleeved in a middle-front portion of the core of the treatment ball, and a wire mesh portion used for fixing the treatment sleeve on the core of the treatment ball and provided in a rear portion of the core of the treatment ball; the face portion covers at least ¾ of an area of the core of the treatment ball from the front end to the rear end, and an opening at a rear end of the wire mesh portion forms a socket fit for the core of the treatment ball.

2. The reciprocating-hit treatment instrument as claimed in claim 1, wherein the main handle portion is provided with a fluctuating finger gripping portion on a same side as the base portion, and a bottom of the main handle portion is integrally connected with a base capable of supporting the body stably at one end.

3. The reciprocating-hit treatment instrument as claimed in claim 1, wherein the reciprocating rod is a snap-in quick-clip connection rod inserted into the base portion.

4. The reciprocating-hit treatment instrument as claimed in claim 1, wherein there are a plurality of replaceable treatment sleeves with different thicknesses; a plurality of bumps integrally connected with the treatment sleeve are uniformly or scatteredly distributed over an upper portion or an entire area of an outer surface of the treatment sleeve.

5. The reciprocating-hit treatment instrument as claimed in claim 1, wherein the reciprocating rod is non-detachably traversed on the body, and the core of the treatment ball is detachably connected with the reciprocating rod, with the core of the treatment ball provided with an internally threaded hole and the front end of the reciprocating rod screwed into the internally threaded hole.

6. The reciprocating-hit treatment instrument as claimed in claim 1, wherein an end of the wire mesh portion close to a rear end of the core of the treatment ball provided with an elastic closing wire in a form of a closed ring, and a wall surface of the front portion of the reciprocating rod is provided with a fixed structure matched with the closing wire for fixing the closing wire.

7. The reciprocating-hit treatment instrument as claimed in claim 6, wherein the fixed structure comprises a stop tongue portion for fixing a winding start-point of the closing wire when the closing wire (404) is wound and a hooked tongue portion for fixing the wound closing wire after the winding is completed, wherein the stop tongue portion is disposed near the front end of the reciprocating rod relative to the hooked tongue portion, extending directions of the stop tongue portion and hooked tongue portion are parallel to a radial cross section of the reciprocating rod and opposite to each other, and the stop tongue portion and hooked tongue portion extend in a direction of a peripheral arc of the reciprocating rod, and a wire-winding area is formed between the stop tongue portion and hooked tongue portion.

8. The reciprocating-hit treatment instrument as claimed in claim 1, wherein a front portion of the reciprocating rod is provided with a locking-rod mechanism which comprises a locking rod capable of reciprocating motion along a direction of the length of the reciprocating rod and a top-pressure spring embedded in the reciprocating rod, wherein a part of the locking rod is embedded in the reciprocating rod to form a guiding rod portion and a part of the locking rod exceeds a peripheral wall surface of the reciprocating rod to form a locking rod portion, and the locking rod portion is connected to a middle portion of the guiding rod portion, with a wall of an internally threaded hole of the core of the treatment ball provided with a locking groove into which the locking rod is inserted.

9. The reciprocating-hit treatment instrument as claimed in claim 1, wherein the treatment sleeve comprises an inner surface adapted to an outer contour of the core of the treatment ball by an interference fit, and a spherical outer surface or an outer shell with an outer contour adapted to positions of a human body.

10. The reciprocating-hit treatment instrument as claimed in claim 9, wherein the outer shell of the treatment sleeve comprises a plurality of hill-shaped projections continuous with a smooth transition.

11. The reciprocating-hit treatment instrument as claimed in claim 9, wherein the outer shell of the treatment sleeve comprises two convex peaks arranged opposite to each other; and a massage groove used for adapting positions of the human body and formed in a middle portion by the opposite-arranged convex peaks.

12. The reciprocating-hit treatment instrument as claimed in claim 9, wherein the outer shell of the treatment sleeve is of an elongated oval shape or an elliptical shape.

13. The reciprocating-hit treatment instrument as claimed in claim 9, wherein the outer shell of the treatment sleeve is of a tapered shape.

14. The reciprocating-hit treatment instrument as claimed in claim 6, wherein the wire mesh portion comprises at least two ring wires symmetrically arranged on the face portion with both end portions of each of the two ring wires integrally fixed with the face portion to form a ringlike shape, and each of the two ring wires passes around the reciprocating rod for a pulling fixation of the face portion.

* * * * *